United States Patent [19]

Radtke

[11] 4,210,257

[45] Jul. 1, 1980

[54] FRACTURE AND TEAR-RESISTANT RETAINED TAB

[75] Inventor: Charles S. Radtke, Little Ferry, N.J.

[73] Assignee: American Can Company, Greenwich, Conn.

[21] Appl. No.: 50,647

[22] Filed: Jun. 21, 1979

[51] Int. Cl.[2] ..... B65D 41/32

[52] U.S. Cl. ..... 220/269; 220/273

[58] Field of Search ..... 220/269, 273

[56] References Cited

U.S. PATENT DOCUMENTS 3,977,561 8/1976 Strobe et al. ..... 220/269

4,150,765 4/1979 Mazurek ..... 220/269

*Primary Examiner*—George T. Hall

*Attorney, Agent, or Firm*—Robert P. Auber; Stuart S. Bowie; William C. Hosford

[57] ABSTRACT

A non-detachable lever tab for easy open container ends with a tongue, the tip of which is staked to the central panel wall by means of an integral rivet. The lancing which forms the tongue terminates in a pair of nail piercings, which afford a high resistance to tear through. The tongue of the lever tab is coined to substantially increase its resistance to fracture under repeated bending.

9 Claims, 8 Drawing Figures

FIG. 4
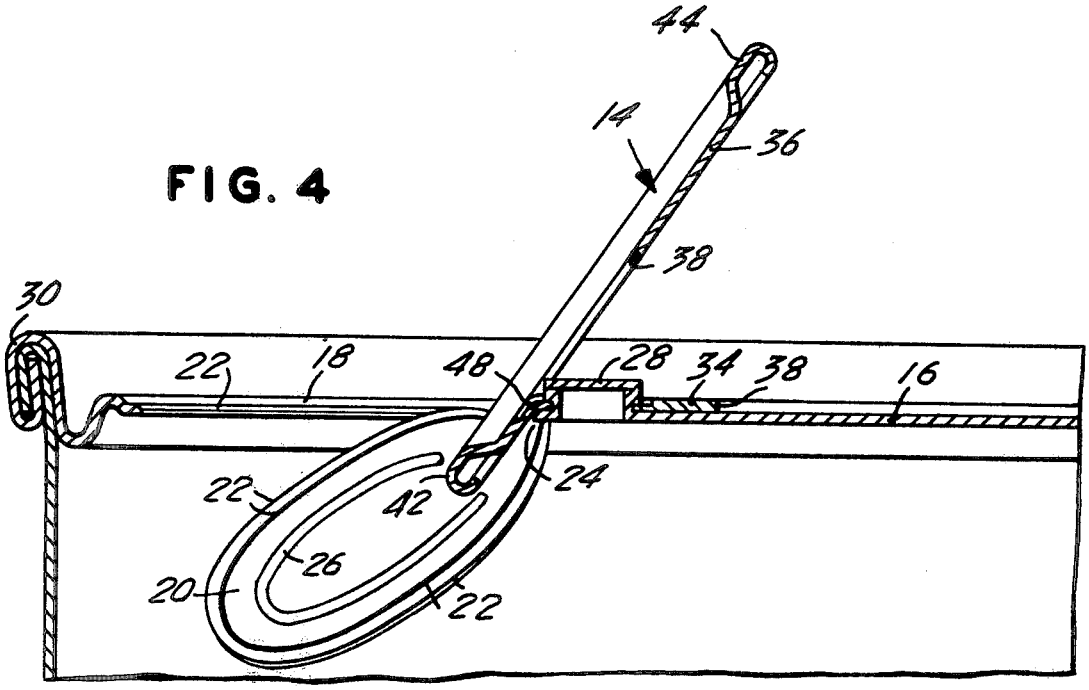
FIG. 5
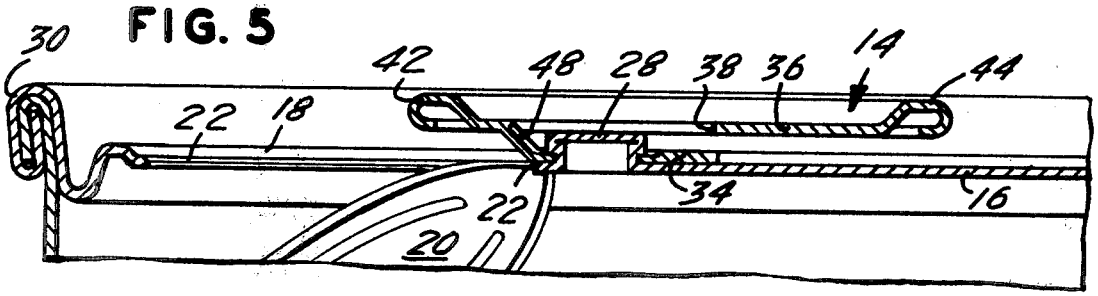
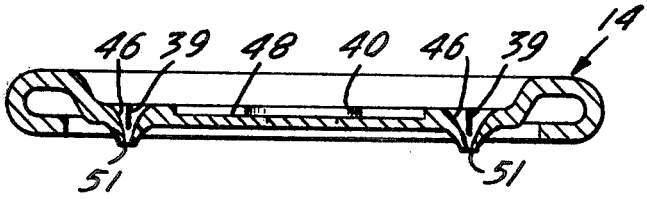
FIG. 6

FRACTURE AND TEAR-RESISTANT RETAINED TAB

BACKGROUND OF THE INVENTION

The market for metal containers has developed widely in recent years due in part to the introduction of the easy open end. While the easy opening feature has been shown to be both effective and convenient, it has given rise to a collateral problem of littering, since traditionally the easy opening feature was pulled free from the container to expose the contents and then subsequently discarded. The indiscriminate disposal of the pull tabs is not only unsightly, but can also present a safety hazard particulary on beaches and in parks.

A number of solutions to the problem have been developed by the container industry with one of the more successful being the retained lever tab. In this structure, the tab is joined to the container end by a tongue or flap which serves as a tab retaining strip after the container has been opened. Since the tab operates as a lever, it must be sufficiently rigid to preclude buckling during the opening process. The rigidity is typically developed in the tab by curling the edges of the tab and also by utilizing tab stock of relatively heavy gage typically 0.018" in thickness. The tongue, which is the bendable member of the tab, when fabricated of such heavy stock, is prone to fracture when subjected to severe bending, as may be encountered when it is bent forward to open the end and then subsequently bent backward to fold the tab out of the way. The situation is further aggravated by the user's inclination to worry the tab by bending it back and forth in an effort to free it from the container in keeping with past practice.

In U.S. Pat. No. 3,967,752 and U.S. Pat. No. 3,967,753 a fracture resistant tongue tab is disclosed wherein a sub-tab of plastic or ductile aluminum is interleafed into the folds of the tab nose to provide a flexible and fracture resistant linkage between the tab and the end. While this composite structure improves the fracture resistance of the tab, it requires additional material and press time for fabrication.

Tear through of the tab tongue, wherein the tongue is extended by tearing of the web, is an additional problem with lever tabs. This condition, which is most apt to arise when score residuals are high, results in a tab which remains attached to the end, but is inoperative.

Accordingly, it is an objective of the instant invention to provide a noval lever type opening feature for easy open containers, which is effective and overcomes the problem of the tab litter.

It is more particularly an objective of the instant invention to provide a lever type tongue tab for easy open containers, which is resistant to both fracture and tear.

Finally, it is an objective of the instant invention to provide a lever style tongue tab, which is simple, highly effective and of inexpensive construction.

SUMMARY OF THE INVENTION

It may be seen that the aforementioned objects of the invention may be attained in an easy open-end closure which comprises; a central panel wall which is adapted for mounting on a container, and is provided with a displaceable panel as defined by scoring therein, and a lever tab joined to the end panel for displacing the panel. The lever tab is longitudinal in shape with a nose end, a lift end and a web therebetween. The web is lanced to form a tongue with its root proximate to the tab nose and its tip disposed toward the lift end of the tab. Flexibility is imparted to the tongue by coining. It is desirable to terminate the lancing which forms the tongue in a pair of nail piercings. It is further desirable to extend the coining from a point on the web proximate the tab nose inwardly, so as to circumscribe the means by which the tab is joined to the end panel.

In the preferred embodiment of the structure, the central panel wall is provided with a peripheral flange for joining the wall to a container body and is further provided with an integral rivet and a displaceable panel.

The displaceable panel is disposed outwardly of the rivet, is of generally circular configuration and is substantially defined by scoring with the extreme ends of the score line separated by an unscored neck, which lies adjacent to the rivet and functions as a permanent hinge for the displaceable panel. The lever tab has an outwardly disposed nose which is positioned over the displaceable panel and a lift which is inwardly disposed. The tab has a central web which is disposed between the nose and the lift end and is lanced to form a tongue. The terminal points of the lance are disposed proximate the tab nose with the unlanced web lying between the terminal points forming the root of the tongue. The tongue is disposed inwardly from its root with its tip apertured and staked to the central panel wall by means of the integral rivet located therein. The web is coined beginning at a point, thereon, falling outward of the rivet and broadening inwardly therefrom. The coining is broadened inwardly to encompass the full width of the tongue and is extended longitudinally inwardly to circumscribe the aperature for the integral rivet.

It is desirable that the residual thickness of web in the coined area of the preferred embodiment be between 0.008" and 0.012" and preferably 0.010". It is further desirable that the lance of the preferred embodiment be terminated in nail piercings.

BRIEF DESCRIPTION OF THE DRAWINGS

FIG. 4 is an enlarged fragmentary sectional view with the tab raised to displace the pour panel inwardly.

FIG. 5 is an enlarged fragmentary sectional view with the pour panel fully displaced and the tab in full repose.

FIG. 6 is an enlarged fragmentary sectional view taken along the line 5—5 of FIG. 1 and showing the nail piercing and its relationship to the coining.

DETAILED DESCRIPTION OF THE ILLUSTRATED EMBODIMENT

Figure 1:
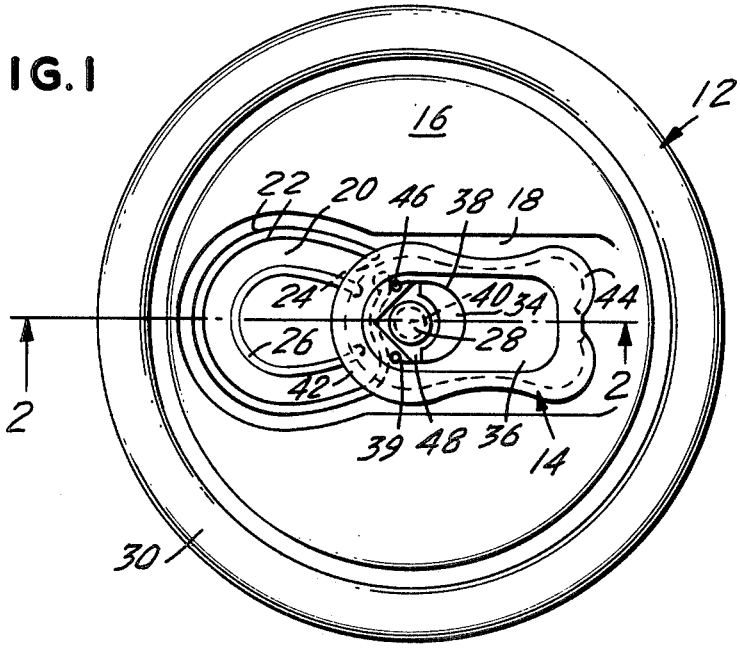
FIG. 1 is a plan view of an end closure embodying the present invention.
Figure 2:
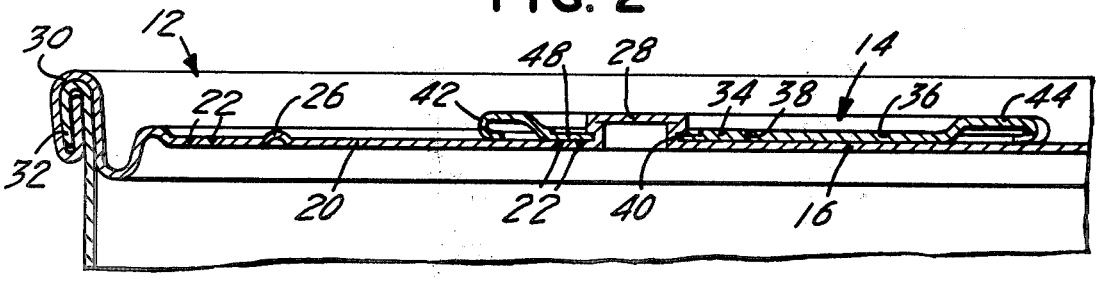
FIG. 2 is an enlarged fragmentary sectional view taken along the line 2—2 of FIG. 1.

Turning now in detail to FIGS. 1 and 2 of the appended drawings, therein illustrated, is an easy open end closure 12 with a non-detachable, fracture and tear resistant tab 14 embodying the present invention. The closure includes a central panel 16 with a deboss panel 18, in which is disposed a displaceable pour panel 20 and the fracture resistant lever tab 14. The displaceable panel 20 is substantially defined by a continuous score line 22 with an unscored neck 24, best shown in FIG. 4, as a means of attachment to the end panel. The pour panel is additionally provided with an upbead 26 which provides structural reinforcement for the panel. The non-detachable fracture and tear resistant tab 14 is a lever-type opening device and is apertured and staked to the closure by means of a rivet 28, which is an integral part of the central panel wall. The tab is received within the deboss panel. The end closure is joined to the container wall, as shown in FIG. 2, by a peripheral flange 30 which is folded over the rim 32 of the can body to form a double seam in accordance with conventional practice. Other suitable joining means may be employed with the instant invention.

Figure 3:
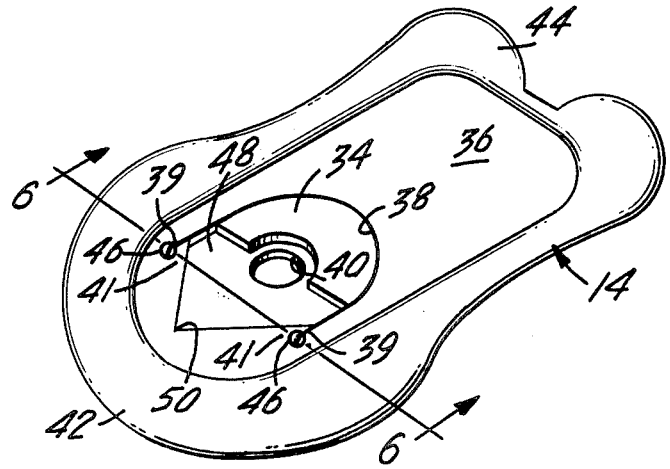
FIG. 3 is an enlarged perspective view of the tab.

The opening device 14 is a lever-type tab with a tongue 34 which is formed by lancing the web 36 of the tab in a U-shaped configuration 38 which partially encircles the rivet aperture 40. The rim of the tab 42 is curled to strengthen the tab against bending or distortion during the opening process. The tab has an outwardly disposed nose 42 and an inwardly disposed lift end 44. The lancing 38 which forms tongue 34 has terminal portions 39. The root of the tongue 41 which lies between the terminal portions is unlanced. Thus, the tongue serves to tie the tab to the central panel of the closure by means of the rivet which passes through the aperture proximate to the tip of the tongue. As has been noted, it is necessary that the tab be sufficiently rigid to preclude buckling during the opening operation. This rigidity is achieved by employing a relatively heavy tab stock, typically of 0.018" thickness, and by curling the rim. The tongue which is subjected to bending during opening and tab lay-back operations is prone to fracture. Fracture generally occurs between the terminal portions of the lance and the rivet hole or tongue aperture. In the instant invention, the metal of tongue, proximate the rivet aperture, is coined in the shape of an arrow head 48 with the point of the arrow head 50 falling on the longitudinal axis of the tab at a point proximate to, but outward of the tongue root, as best seen in FIG. 3. It should be especially emphasized that by coining the tongue in the area of its root, where it joins the web proper and where the tab is subjected to a bending stress which is apt to cause metal fracture, the bendability of the metal is increased. It has been found that by coining the metal to a residual thickness of 0.008" to 0.012" preferably 0.010" from its original thickness of 0.018", the resulting tab can withstand 3 or more complete bends without exhibiting metal fracture of the tongue, whereas the uncoined tab exhibited failure within 1–2 complete bends.

Nail piercings 46 are employed at the terminal portions of the tab lancing to prevent tear through. Tear through is a mode of tab failure which occurs when the lancing is extended by tearing of the web. This tearing occurs during the initial stages of the opening process when the tab lift end is raised to exert leverage on scored displaceable pour panel. Tear through results in a tab with an extended tongue which leaves the tab attached to the end, but incapable of exerting leverage on the displaceable panel. The traditional tear prevention means are a reverse curl or an aperture both of which are planar and not completely satisfactory where the tear forces are high as with high score residuals. In a reverse curl, the lance makes a 180° bend, so that it is inwardly directed toward the tongue tip rather than the tongue root. The use of an aperture or hole at the terminal end of a lance is likewise planar and functions by providing a discontinuity which tends to distribute, rather than concentrate the tear stress. In the instant structure, the tear prevention means consists of nail piercing where the tab is pierced, so that the metal is forced beyond the plane of the web. The three dimensional nature of nail piercing, as shown in FIG. 6, is highly effective in preventing tearing of the web, in that any tearing stress is not only distributed but is further directed out of the plane of the web, by the projected tip 51. An additional benefit which results from nail piercing is that no scrap is generated by the piercing process which would cause fouling of the dies, transfer slide or other moving parts of the press.

Figure 7:
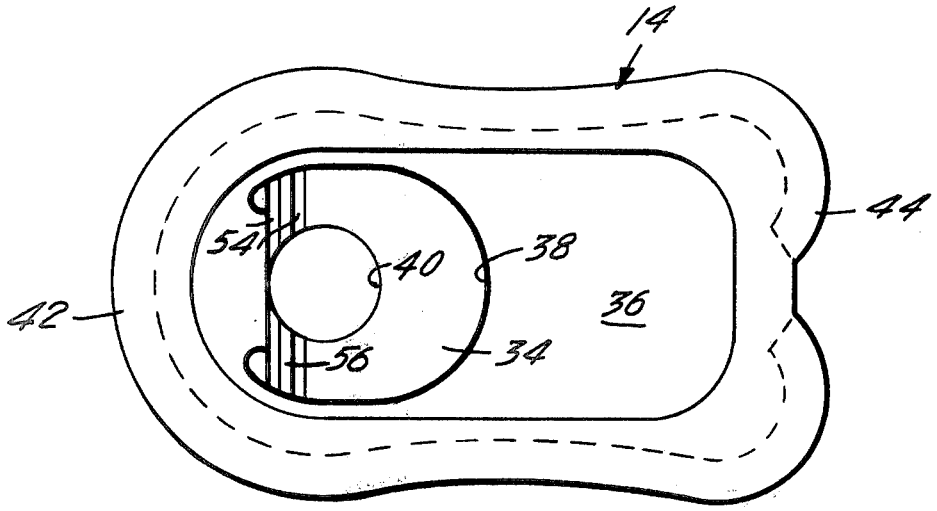
FIG. 7 is an enlarged plan view of a second embodiment of the present invention.
Figure 8:
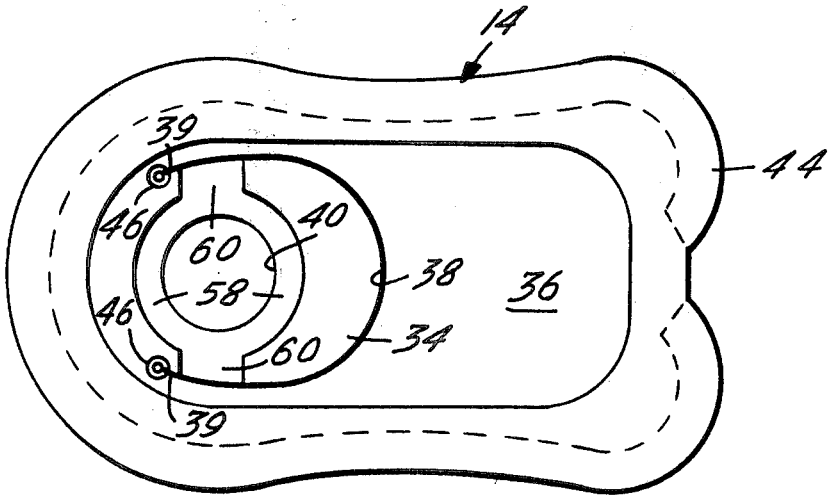
FIG. 8 is an enlarged plan view of a third embodiment of the present invention.

While the preferred embodiment, as shown in FIGS. 1 through 5, is in the configuration of an arrow head, other configurations are also effective. In FIG. 7, a series of bands 54 are coined transversely across the web with alternate bands of uncoined metal 56 therebetween. The bands are disposed in the tongue and web areas proximate the areas of bending. In FIG. 8, a third embodiment is illustrated, wherein the coining is effected in a substantially circular configuration 58 concentric with the rivet hole with transverse extensions 60 which carry the coining to the lancing.

While other coined configurations may be employed effectively to impart the requisite bendability to the tongue, it is advantageous to extend the coining so that it encompasses the area of the rivet hole. By so doing, it is possible to reduce the required rivet height by an extent equal to the depth of coining. This reduction becomes increasingly critical when the thickness of the end stock is diminished or when the ends are made of steel rather than aluminum.

In operation, the lever tab is employed to open the end closure by inserting a finger nail under the curled end of the tab lift or handle 44. As the lift end is raised, the nose of the tab bears against the pour panel and the panel wall, forward of the rivet, to effect rupture of the score line. After initial rupture of score line, proximate the rivet, the opening process may be continued by elevating the tab lift end until it is approximately perpendicular to the plane of the end panel. At this point, the pour panel is fully displaced into the container. The tab lift end may then be folded back out of the way by folding into a plane parallel to the end panel in a position of repose, as shown in FIG. 5.

Filed on even date, herewith, is an application in the name of Neal E. Langseder entitled, "FRACTURE RESISTANT RETAINED LEVER TAB AND METHOD OF MANUFACTURE", and bearing Ser. No. 050,649; the specification, thereof, is hereby incorporated by reference.

Thus it can be seen that the instant invention provides a novel lever type opening feature for easy open containers, which is effective and which avoids the problem of tab litter. More particularly, the instant invention provides a lever tab which is both fracture and tear resistant, and remains attached to the container end despite repeated bending and rebending. Finally, it can be seen that the tab structure is designed for effectivenes, but of simple and inexpensive construction.

It is believed that the foregoing general and detailed descriptions are explanatory of the present invention. It will be apparent that changes and modifications may be made without departing from the spirit and scope of the invention as defined by the appended claims.

What is claimed is:

1. An easy open closure for a container comprising:

(a) a central panel wall including means for joining said wall to said container;

(b) a displaceable panel in said panel wall at least substantially defined by scoring;

(c) a lever tab with a nose end and a lift end and a central web disposed therebetween, said web being lanced to form a tongue with the root of said tongue proximate said tab nose and the tip of the tongue disposed toward said lift end and wherein said tongue is coined to impart bendability thereto; and (d) means for joining said tongue to said end wall.

2. The container end closure as recited in claim 1, wherein said tongue lancing terminates in a pair of nail piercings.

3. The easy open closure as recited in claim 2, wherein said coining extends from a point on the web proximate said tab nose inwardly to circumscribe said joining means with transverse extentions which carry the coining to said lancing.

4. The easy open closure as recited in claim 2, wherein the portion of said tongue lying between said root and said means for joining said tongue to said end panel is worked to form a series of transverse parallel bands of alternating coined and uncoined metal.

5. The easy open closure as recited in claim 2, wherein said coining is substantially circular in configuration and extends transversely to join said lancing.

6. An easy open closure for a container comprising:

(a) a central panel wall including a peripheral flange for joining said container and an integral rivet centrally disposed in said panel wall;

(b) a displaceable panel in said central panel wall disposed outwardly of said rivet of generally circular configuration substantially defined by scoring with the extremities of said scoring separated by an unscored neck proximate said rivet and wherein said unscored neck provides a permanent hinged attachment of said displaceable panel to said central panel wall; and (c) a lever tab with an outwardly disposed nose overlying a portion of said displaceable panel and an inwardly disposed lift end and a central web disposed therebetween and wherein said web is lanced to form a tongue with the terminal portions of said lance disposed proximate said tab nose and wherein the unlanced web lying between said terminal portion forms the root of said tongue with said tongue disposed inwardly therefrom and wherein said tongue tip is apertured and staked to said central panel by means of said integral rivet, and wherein a portion of said web is coined in the shape of an arrow head beginning at a point thereon falling outward of said tongue root and broadening inward therefrom, transversely to encompass the full width of said tongue and longitudinally inward along said tongue to circumscribe said rivet aperture, whereby said lever tab may be employed to inwardly displace said displaceable panel, assuming a first posture generally perpendicular to the plane of said central panel wall with said tab nose down and said tab left raised after which said tab may be bent back to position of repose wherein said tab lies parallel to the plane of said central panel and wherein said coined tongue is sufficiently bendable to permit repeated bending and rebending without said tongue completely fracturing.

7. The easy open closure as recited in claim 6 wherein said web is coined to a residual thickness of 0.008" to 0.012".

8. The easy open closure as recited in claim 6 wherein said web is coined to a residual thickness of 0.010".

9. The easy open closure as recited in claim 6 wherein said lance terminates in a pair of nail piercings which increase the tear resistance of the web in the area of the lance.

* * * * *